United States Patent [19]

Kohlstette et al.

[11] Patent Number: 4,670,005

[45] Date of Patent: Jun. 2, 1987

[54] CENTRIFUGE WITH A SELF-EMPTYING DRUM

[75] Inventors: Werner Kohlstette; Rudolf Koch, both of Oelde, Fed. Rep. of Germany

[73] Assignee: Westfalia Separator AG, Oelde, Fed. Rep. of Germany

[21] Appl. No.: 836,888

[22] Filed: Mar. 6, 1986

[30] Foreign Application Priority Data

Mar. 14, 1985 [DE] Fed. Rep. of Germany ..... 3509139

[51] Int. Cl.[4] ..... B04B 11/02

[52] U.S. Cl. ..... 494/40; 494/27

[58] Field of Search ..... 494/40, 27, 23, 25, 494/26, 29, 30, 48, 56

[56] References Cited

U.S. PATENT DOCUMENTS 3,550,843 12/1970 Hoffmann ..... 494/40
4,044,945 8/1977 Gunthard ..... 494/27
4,479,788 10/1984 Kohlstette ..... 494/40
4,498,897 2/1985 Gunnewig ..... 494/40
4,505,698 3/1985 Broker ..... 494/40

*Primary Examiner*—Robert W. Jenkins
*Attorney, Agent, or Firm*—Sprung Horn Kramer & Woods

[57] ABSTRACT

The centrifuge has a self-emptying drum. There are expulsion apertures in the bottom of the drum. The apertures lead from a solids space and can be closed off with a piston slide. A closure chamber that can be charged with closure liquid is associated with the piston slide. The closure chamber communicates with a chamber through a bleed channel in the form of an annular gap and through a valve gap. The annular gap has an extensive cross-section that promotes rapid flow and accordingly especially accelerates bleeding the closure liquid out of the closure chamber into the other chamber. This makes it possible to increase the stroke of the piston slide at a prescribed extraction volume when the drum empties.

8 Claims, 3 Drawing Figures

CENTRIFUGE WITH A SELF-EMPTYING DRUM

BACKGROUND OF THE INVENTION

The present invention relates to a centrifuge with a self-emptying drum, wherein the wall of the drum has expulsion apertures that lead from a solids space and that can be closed off by a piston slide, wherein a closure chamber, which has channels that closure liquid is supplied through, is associated with the piston slide, wherein the circumference of the closure chamber has at least one outlet channel with the associated hydraulically regulated body of a valve, and wherein the outlet channel opens into a chamber that bleed perforations, each of which has a constriction, extend out of through the wall of the drum.

A centrifuge of this type is known, from German Pat. No. 3,208,808 for example. The bleed channel is a perforation that has a sealing plate secured to a cam-like projection associated with it. There are usually several bleed channels of this type distributed uniformly around the circumference to maximize the flow cross-section. Still, the number and diameter of the bleed channels and hence the overall cross-section available for bleeding the closure water out of the closure chamber is limited by economics and structural strength. Also, a valve body with radial projections is relatively expensive to manufacture, and the sealing plate has close tolerances because an unobjectionable seal can only be attained when there are several sealing plates when their surfaces are precisely in one plane. How fast the closure liquid can be bled out of the closure chamber depends or, among other factors, the flow cross-section of the bleed channels. The more rapidly the liquid is bled out, the longer the attainable opening stroke of the piston slide to extract a prescribed portion of the contents of the drum. The opening stroke must be long to ensure extraction of solids that tend to bridge subject to powerful centrifugal forces within the drum. Thus, the attainable piston-slide stroke is a compromise.

SUMMARY OF THE INVENTION

The object of the present invention is to accelerate emptying the closure chamber while decreasing manufacturing costs.

This object is attained in accordance with the invention in a centrifuge of the aforesaid type wherein the bleed channel is an annular gap. The attainable flow cross-section of an annular gap is absolutely optimal at a prescribed valve-body stroke. The principle behind the operation of an annular gap has made it impossible to employ with known valve bodies without taking serious drawbacks into account.

The proposed solution makes it possible to eliminate the expensive drilling of bleed channels and makes the valve body more economical to manufacture.

A bleed channel of this type can be created in a practical way by leaving an annular gap, with dimensions corresponding to the desired flow cross-section, between the outer surface of the valve body and an inner surface, concentric thereto, on the bottom of the drum.

The upper surface of the valve body in one preferred embodiment of the invention is in the closure chamber in the piston slide 5. The principle behind this embodiment is the reverse of that behind known valve bodies, which ascend to close off the bleed channels and descend to open them up. Reversing the principle, so that the bleed channels are open when the valve bodies are up and closed when they are down, avoids the necessity of specially associating the closure chamber with the valve body. Closure pressure is generated by the closure liquid in the closure chamber in the piston slide that contains the upper surface of the valve body. This design is an especially simple and cost-effective means of attaining the object of the invention.

A prescribed minimal flow cross-section can be attained between the valve body and the piston slide if a stop, that limits its upward motion, is associated with the valve body. A simple means of attaining this mechanism is to position the stop on a ring between the piston slide and the bottom of the drum. To prevent stressing the screws that fasten the ring to the bottom of the drum the stop can be positioned on the upper surface of the piston slide 5. The stop in one practical embodiment of the invention can consist of ribs on the surface of the valve body.

Another practical embodiment of the invention has compression springs in the opening chamber that exert additional opening force on the valve body. It is unnecessary in this embodiment to divert part of the surface of the valve body through a ring to keep the closure force weaker than the opening force. This is an especially simple and low-cost design.

Some preferred embodiments of the invention will now be described with reference to the attached drawings, wherein:

DETAILED DESCRIPTION OF THE PREFERRED EMBODIMENTS

Figure 1:
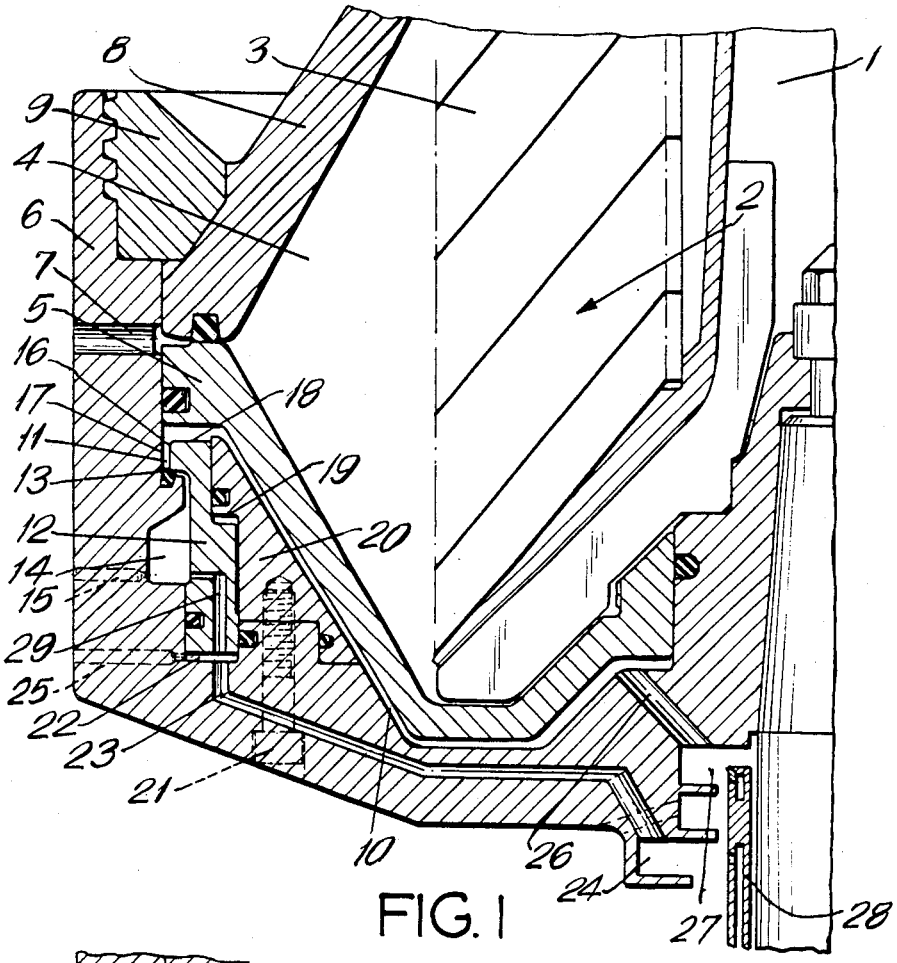
FIG. 1 is a partial section through a centrifuge drum in accordance with the invention with the stop that limits the motion of the body of the valve positioned on a ring.

Referring now to FIG. 1, the centrifugate is supplied to a centrifuging space 2, that consists of a separation space 3 and a solids space 4, through a central inlet 1. One side of solids space 4 is demarcated by a piston slide 5 that moves axially to open up and close off apertures 7 in the bottom 6 of the drum. The solids are expelled through apertures 7. The drum also has a cover 8 that is secured to bottom 6 by a sealing ring 9. Below piston slide 5 is a closure chamber 10 that can be charged with closure liquid. Closure chamber 10 communicates with a chamber 14 through an annular gap 11 and a valve gap 13. Valve gap 13 can be closed off with the valve body 12. Bleed perforations 15, each of which has a constriction, extend out through the bottom of the drum from chamber 14. Annular gap 11 is left between the outer surface 16 of valve body 12 and the inner surface 17 of the bottom 6 of the drum. The upper surface 18 of valve body 12 is in the vicinity of closure chamber 10. The upward motion of valve body 12 is limited by a stop 19 positioned on a ring 20 that is fastened to the bottom 6 of the drum with screws 21. This mechanism ensures a minimal cross-section between the upper surface 18 of valve body 12 and piston slide 5 that will be more extensive than the bleed cross-section of annular gap 11. Below valve body 12 is an opening chamber 22 that can be charged with opening water through channels 23 and catch chamber 24. The opening water can be bled out of opening chamber 22 again through calibrated channels 25. Closure chamber 10, which is below piston slide 5, communicates with a closure-water catch gutter 27 through a channel 26. Opening and closure water is supplied through a control-water supply 28.

Before the centrifugate is supplied to inlet 1, closure chamber 10 is charged with closure water through channel 26, catch gutter 27, and control-water supply 28, forcing piston slide 5 into the closure position.

Since the pressure of the liquid in closure chamber 10 also acts on the upper surface 18 of valve body 12, it will force the valve body into the closure position. Thus, valve body 12 does not require a special closure chamber.

To initiate emptying the drum, opening chamber 22 is charged with opening water through channels 23 and catch chamber 24, forcing valve body 12 up against stop 19 and releasing valve gap 13. The closure water now flows rapidly out of closure chamber 10 because the cross-sections available to it are so extensive, and into chamber 14, suddenly releasing the pressure in closure chamber 10. The pressure of the liquid in separation space 3 and solids space 4 forces piston slide 5 into its opening position just as rapidly, completely or partially emptying the drum. As soon as chamber 14 is full of closure liquid, bleeding is immediately terminated, and the closure liquid still in closure chamber 10 forces piston slide 5 into the closure position. Closure chamber 10 is charged with closure water from control-water supply 28 through catch gutter 27 and channels 26 even while the drum is being emptied, and fills again immediately subsequent to the termination of bleeding. Chamber 14 is large enough to accommodate all the closure water from closure chamber 10. This makes it possible to carry out "total emptying," in which all the contents of the drum are extracted. If the process called "partial emptying," in which only the solids are extracted, is to be carried out, chamber 14 can be partly charged with liquid through channel 29 by supplying opening water with less power before the actual emptying process, so that only some of the closure liquid is bled out of closure chamber 10. The opening motion of piston slide 5 is accordingly terminated sooner. Once valve gap 13 is sealed, chamber 14 will empty through bleed perforations 15.

Figure 2:
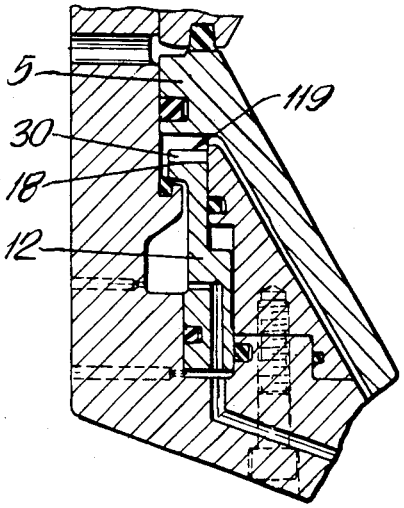
FIG. 2 is a partial section through a centrifuge drum in accordance with the invention with the stop that limits the motion of the valve body positioned on the piston slide.

The stop 119 that limits the motion of valve body 12 in the embodiment illustrated in FIG. 2 is positioned on the upper surface 18 of the body. Stop 119 consists of several ribs 30 on the upper surface 18 of valve body 12 that come to rest against piston slide 5 as valve body 12 moves up.

Figure 3:
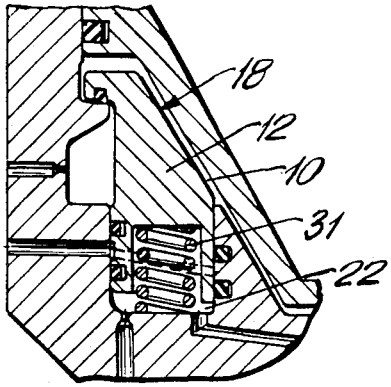
FIG. 3 is a partial section through a centrifuge drum in accordance with the invention with compression springs in the opening chamber.

FIG. 3 illustrates an embodiment with compression springs 31 in opening chamber 22 that exert additional opening force on valve body 12. This eliminates the need for a ring to reduce the effective surface 18 of valve body 12 in closure chamber 10. Compression springs 31 will ensure that valve body 12 opens even when the effective surfaces of the valve body in opening chamber 22 and in closure chamber 10 are equal and when the pressures in both chambers are approximately equal when opening is initiated.

It will be appreciated that the instant specification and claims are set forth by way of illustration and not limitation, and that various modifications and changes may be made without departing from the spirit and scope of the present invention.

What is claimed is:

1. In a centrifuge with a self-emptying drum, wherein the wall of the drum has expulsion apertures that lead from a solids space, a piston slide for opening and closing off the apertures, a closure chamber for the piston slide with channels through which closure liquid is supplied, at least one outlet channel at the circumference of the closure chamber, a valve body for opening and closing the at least one outlet channel, a chamber into which the at least one outlet channel opens into, bleed perforations each having a constriction and extending out of the chamber through the wall of the drum, the improvement comprising means forming a bleed channel in each outlet channel comprising means forming an annular gap.

2. The centrifuge as in claim 1, wherein the annular gap has dimensions corresponding to a desired flow cross-section is formed between an outer surface of the valve body and an inner surface, concentric thereto on the bottom of the drum.

3. The centrifuge as in claim 2, wherein an upper surface of the valve body is in the closure chamber for the piston slide.

4. The centrifuge as in claim 1, further comprising means forming a stop that limits the upward motion of the valve body.

5. The centrifuge as in claim 4, wherein means forming the stop comprises a ring between the piston slide and the bottom of the drum.

6. The centrifuge as in claims 4, wherein the stop is positioned on an upper surface of the valve body.

7. The centrifuge as in claim 6, wherein the stop comprises ribs on the upper surface of the valve body.

8. The centrifuge as in claim 1, wherein the valve body has an opening chamber and further comprising compression springs in the opening chamber for exerting an opening force on the valve body.

* * * * *